US008308263B2

(12) United States Patent
Murakami et al.

(10) Patent No.: US 8,308,263 B2
(45) **Date of Patent: *Nov. 13, 2012**

(54) DROPLET EJECTING APPARATUS

(75) Inventors: Atsushi Murakami, Kanagawa (JP); Masaki Kataoka, Kanagawa (JP); Masahito Katada, Kanagawa (JP); Yuko Katada, legal representative, Kanagawa (JP); Natsuki Katada, legal representative, Kanagawa (JP); Daichi Katada, legal representative, Kanagawa (JP); Tetsuzo Kadomatsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 335 days.

This patent is subject to a terminal disclaimer.

(21) Appl. No.: 12/642,977

(22) Filed: Dec. 21, 2009

(65) Prior Publication Data

US 2010/0188453 A1 Jul. 29, 2010

(30) Foreign Application Priority Data

Jan. 26, 2009 (JP) ..... 2009-013900

(51) Int. Cl.
*B41J 29/38* (2006.01)

(52) U.S. Cl. ..... 347/14; 347/15

(58) Field of Classification Search ..... 347/14, 347/15

See application file for complete search history.

(56) References Cited

U.S. PATENT DOCUMENTS

| | | | | |
|---|---|---|---|---|
| 7,850,290 | B2 | 12/2010 | Nitta et al. | |
| 8,070,248 | B2 | 12/2011 | Ogama | |
| 2002/0012023 | A1* | 1/2002 | Shigeno | 347/29 |
| 2002/0196318 | A1* | 12/2002 | Shimizu | 347/85 |
| 2007/0216739 | A1 | 9/2007 | Uchida et al. | |
| 2011/0050794 | A1 | 3/2011 | Koike et al. | |
| 2011/0074892 | A1 | 3/2011 | Murakami et al. | |

FOREIGN PATENT DOCUMENTS

| | | |
|---|---|---|
| JP | 11-091137 | 4/1999 |
| JP | 2000-108363 | 4/2000 |
| JP | 2005-053047 | 3/2005 |
| JP | 2005053047 A * | 3/2005 |
| JP | 2005-349843 | 12/2005 |

OTHER PUBLICATIONS

Notice of Allowance in U.S. Appl. No. 12/725,608 dated May 7, 2012.

* cited by examiner

*Primary Examiner* — Laura Martin
(74) *Attorney, Agent, or Firm* — Fildes & Outland, P.C.

(57) ABSTRACT

A droplet ejection apparatus includes droplet ejection units each including a supply port and an ejection port, a common supply flow path, a common discharge flow path, supply flow paths that connect the supply port to the common supply flow path, openable mechanisms provided at the supply flow paths, discharge flow paths that connect the ejection port to the common discharge flow path, one-way valves provided at the discharge flow paths, a pressure applying unit, and a controller. When performing a maintenance operation of a selected droplet ejection unit, the controller applies a pressure with the pressure applying unit so that the pressure in the plural discharge flow paths at the common discharge flow path side with respect to the respective one-way valves is higher than the other side, and opens only the openable mechanism corresponding to the selected droplet ejection unit.

4 Claims, 8 Drawing Sheets

WHEN RECOVERY COMMON FLOW PATH IS PRESSURIZED

WHEN THERE IS FLOW FROM MODULE TO RECOVERY COMMON FLOW

WHEN THERE IS NEITHER FLOW NOR PRESSURE DIFFERENCE

WHEN THERE IS FLOW FROM MODULE TO RECOVERY COMMON FLOW PATH

WHEN THERE IS NEITHER FLOW NOR PRESSURE DIFFERENCE, OR WHEN RECOVERY COMMON FLOW PATH IS PRESSURIZED

WHEN THERE IS FLOW FROM MODULE TO RECOVERY COMMON FLOW PATH

WHEN THERE IS NEITHER FLOW NOR PRESSURE DIFFERENCE, OR WHEN RECOVERY COMMON FLOW PATH IS PRESSURIZED

DROPLET EJECTING APPARATUS

CROSS-REFERENCE TO RELATED APPLICATION

This application is based on and claims priority under 35 USC 119 from Japanese Patent Application No. 2009-013900 filed on Jan. 26, 2009.

BACKGROUND

1. Technical Field

The present invention relates to a droplet ejection apparatus.

2. Related Art

In an ink-jet recording apparatus, ink retained inside nozzles that eject ink droplets will be deteriorated as a result of contacting with air. Therefore, a maintenance operation is needed to be done regularly, in which the ink retained inside the nozzles and ink retained inside a recording head in which the nozzles are formed are replaced by ejecting (discharging) the ink droplets from the nozzles.

SUMMARY

An aspect of the present invention is a droplet ejection apparatus including: plural droplet ejection units each respectively including a supply port for supplying liquid, an ejection port for ejecting the liquid, and an ejection mechanism that ejects the supplied liquid as droplets; a common supply flow path that supplies the liquid to the plural droplet ejection units; a common discharge flow path that recovers the liquid from the plural droplet ejection units; plural supply flow paths that each connect the supply port of each of the plural droplet ejection units to the common supply flow path; plural openable mechanisms provided at the plural supply flow paths, respectively; a plural discharge flow paths that each connect the ejection port of each of the plural droplet ejection units to the common discharge flow path; plural one-way valves that are respectively provided at the plural discharge flow paths to block the flow of the liquid from the common discharge flow path toward the ejection ports of the respective droplet ejection units; a pressure applying unit that applies pressure so that a pressure in the plural discharge flow paths at the common discharge flow path side with respect to the respective one-way valves is higher than the other side; and a controller that when performing a maintenance operation of a selected droplet ejection unit, applies a pressure with the pressure applying unit so that the pressure in the plural discharge flow paths at the common discharge flow path side with respect to the respective one-way valves is higher than the other side, and opens only the openable mechanism corresponding to the selected droplet ejection unit from among the plural openable mechanisms.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
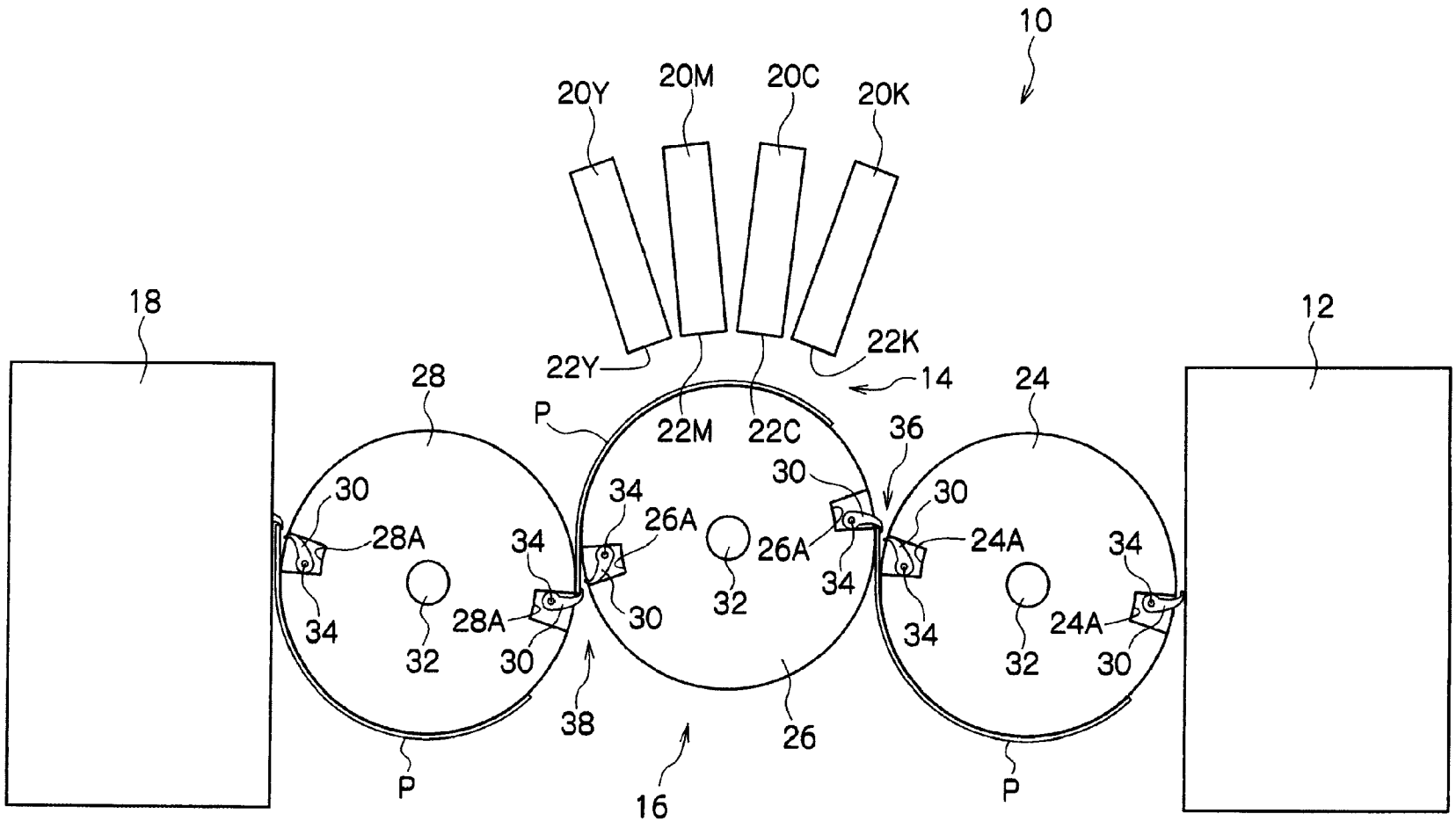
FIG. 1 is a schematic configuration diagram of an ink jet recording apparatus according to the exemplary embodiments.

FIG. 1 shows an ink-jet recording apparatus 10 according to the exemplary embodiments. The ink jet recording apparatus 10 ejects ink droplets to record an image on a recording medium. As shown in FIG. 1, the ink-jet recording apparatus 10 has a recording medium storage 12 in which a recording medium P such as paper is stored, an image recording unit 14 that records an image on the recording medium P, a conveyance unit 16 that conveys the recording medium P from the recording medium storage 12 to the image recording unit 14, and a recording-medium discharge unit 18 that ejects the recording medium P on which an image is recorded by the image recording unit 14.

The image recording unit 14 has ink-jet recording heads 20Y, 20M, 20C, and 20K. The ink jet recording heads 20Y to 20K are disposed along a conveyance direction of the recording medium P in this order, and respectively eject inks of colors (Y (yellow), M (magenta), C (cyan), and K (black)) different from one another through plural nozzles as droplets (ink droplets), using ejection mechanisms incorporated in the inkjet recording heads 20Y to 20K in piezoelectric method. In this way, a color image is recorded on the recording medium P. The ejection mechanisms of the inkjet recording heads 20Y to 20K may be configured to eject the ink droplets by a method other than the piezoelectric method (e.g., by a thermal method or the like).

The nozzles (not illustrated) of the ink-jet recording heads 20Y to 20K are formed in surfaces (nozzle surfaces 22Y to 22K) opposing to the recording medium P of the ink jet recording heads 20Y to 20K. Each of the nozzle surfaces 22Y to 22K of the ink-jet recording heads 20Y to 20K is formed so that the length of a recordable area of each of the ink-jet recording heads 20Y to 20K along a width direction of the recording medium P is substantially equal to or greater than a maximum width of the recording medium P to which image recording is expected to be performed by the ink jet recording apparatus 10.

The conveyance unit 16 has a taking-out drum 24 that takes out the recording medium P stored in the recording medium storage 12 one by one, a conveyance drum 26 that conveys the recording medium P to a position opposing to the nozzle surfaces 22Y to 22K of the ink-jet recording heads 20Y to 20K of the image recording unit 14, and a sending-out drum 28 that sends out the recording medium P on which an image is recorded by the image recording unit 14 to the recording-medium discharge unit 18. Each of the taking-out drum 24, the conveyance drum 26, and the sending-out drum 28 hold the recording medium P on the circumferential surface thereof by an electrostatic adsorption or a non-electrostatic adsorption such as suction, adhesion or the like.

Further, the taking-out drum 24, the conveyance drum 26 and the sending-out drum 28 respectively have pairs of concavities 24A, 26A, 28A in the circumferential surface thereof. Inside the concavities 24A, 26A, 28A of the drums 24, 26, 28, rotating shafts 34 are supported at respective predetermined positions and in parallel to rotating shafts 32 of the drums 24, 26, 28. Plural grippers 30 are fixed to the respective rotating shafts 34 with intervals (e.g., with even intervals) in an axial direction thereof. Each of the rotating shafts 34 rotates in both forward and backward directions by an actuator which is not shown. Due to this rotation, the gripper 30 fixed to the each of the rotating shafts 34 is rotated between a first position at which a tip portion projects out from the circumferential surface of the drum and come into contact with the circumferential surface of the drum, and a second position at which the whole gripper 30 is substantially accommodated in the concavity. The grippers 30 thus can nip and hold an end portion of the recording medium P which is downstream in the conveyance direction, or release the same. Each of the drums 24, 26, 28 can hold up to two recording mediums P on the circumferential surface thereof by the grippers 30, and can further pass the recording medium P between the respective drums 24, 26, 28.

Here passing of the recording medium P from the taking-out drum 24 to the conveyance drum 26 is described for instance. In a state in which the grippers 30 of the conveyance drum 26 side are at positions where they slightly rotate from the first position toward the second position (i.e., position where a gap is formed between the tip portion of each of the grippers 30 and the circumferential surface of the conveyance drum 26), a leading end of the recording medium P conveyed by the taking-out drum 24 reaches a pass position 36 at which the circumferential surface of the taking-out drum 24 opposes the circumferential surface of the conveyance drum 26. Then, the grippers 30 of the taking-out drum 24, which have held the leading end of the recording medium P, rotate to the second position, and the leading end of the recording medium P enters into the gaps between the tip portions of the grippers 30 of the conveyance drum 26 and the circumferential surface of the conveyance drum 26. In this state, the grippers 30 of the conveyance drum 26 are rotated to the first position, and the leading end of the recording medium P is nipped and held between the tip portions of the grippers 30 and the circumferential surface of the conveyance drum 26. In this way, the passing of the recording medium P from the taking-out drum 24 to the conveyance drum 26 is completed.

In image recording on the recording medium P, the recording medium P stored in the recording medium storage 12 is taken out one by one from the recording medium storage 12 by the grippers 30 of the taking-out drum 24 and held, conveyed while being held on the circumferential surface of the taking-out drum 24, and passed from the grippers 30 of the taking-out drum 24 to the grippers 30 of the conveyance drum 26 at the pass position 36. The recording medium P held by the grippers 30 of the conveyance drum 26 is conveyed to an image recording position by the ink jet recording heads 20Y to 20K while being held on the circumferential surface of the conveyance drum 26, and an image is recorded on a recording surface of the recording medium P using the ink droplets ejected from the inkjet recording heads 20Y to 20K. The recording medium P having the image recorded on the recording surface is passed from the grippers 30 of the conveyance drum 26 to the grippers 30 of the sending-out drum 28 at a pass position 38. The recording medium P held by the grippers 30 of the sending-out drum 28 is conveyed while being held on the circumferential surface of the sending-out drum 28 and ejected to the recording-medium discharge unit 18.

Next, the configuration of an ink supply system that supplies the inks to the ink-jet recording heads 20Y to 20K of the image recording unit 14 is described. Since the ink supply systems corresponding to the respective ink-jet recording heads 20Y to 20K have the same configuration, the configuration of the ink supply system of the ink-jet recording head 20Y is described as an example.

Figure 2:
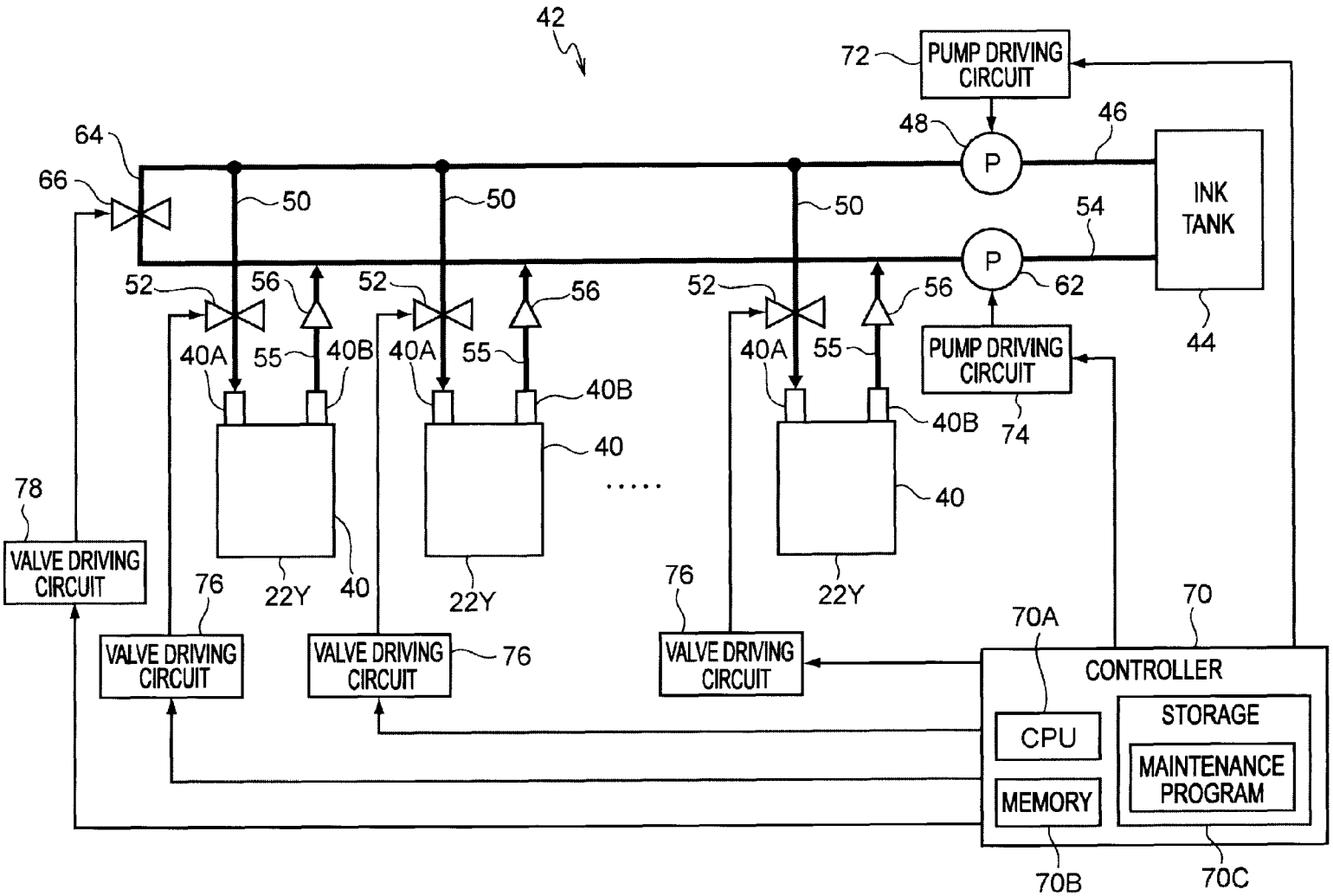
FIG. 2 is a schematic configuration diagram of an ink supply system according to a first exemplary embodiment.

FIG. 2 shows an ink-supply system 42 of the ink-jet recording head 20Y. The ink-jet recording head 20Y has plural ink-droplet ejection modules 40 (similarly in the ink jet recording heads 20M to 20K). Each of the ink-droplet ejection modules 40 is provided with a supply port 40A for supplying the ink (as one example of a liquid) to the ink-droplet ejection module 40, and a discharge port 40B for discharging the ink from the ink-droplet ejection module 40. The ink-droplet ejection module 40 corresponds to a droplet ejection unit.

The ink supply system 42 includes an ink tank 44 that stores the ink (more particularly, ink in Y color because the ink supply system 42 shown in FIG. 2 is for the ink jet recording head 20Y). The ink stored in the ink tank 44 includes various inks such as a water-based ink, an oil-based ink, a solvent ink and the like. One end of a supply common tube 46 is connected to the ink tank 44. The supply common tube 46 is made in, for example, tubular form, and the ink can be distributed therethrough. The supply common tube 46 corresponds to a common supply flow path.

A supply pump 48 is disposed at the supply common tube 46. The supply pump 48 can be rotated normally and reversely. When the supply pump 48 is normally rotated, pressure (positive pressure) is applied inside the supply common tube 46 and the ink stored in the ink tank 44 is fed in the supply common tube 46 toward the ink-droplet ejection module 40. The supply pump 48 may be rotated reversely only for a short time in a state in which the pressure is applied inside the supply common tube 46, and in this case, the pressure applied to the supply common tube 46 is released and the feeding of the ink is stopped.

At plural different positions of the supply common tube 46, one ends of plural supply tubes 50 are respectively connected, and the other ends of the plural supply tubes 50 are respectively connected to the supply port 40A of the plural ink-droplet ejection modules 40. Each of the supply tubes 50 is also made in tubular form as well as the supply common tube 46, and the ink can be distributed through the tube. Thus, due to the normal rotation of the supply pump 48, the ink fed toward the ink-droplet ejection module 40 through the supply common tube 46 is distributed to each of the supply tubes 50 and is supplied to each of the ink-droplet ejection modules 40 through the supply port 40A thereof. The supply tube 50 corresponds to a supply flow path.

At the supply tubes 50, supply valves 52 which are an openable valves, are respectively disposed. When the supply valve 52 is in an opened state, the ink can be flow through the supply tube 50. When the supply valve 52 is switched to a closed state, the ink flow inside the supply tube 50 is blocked, and the supply of the ink to the corresponding ink-droplet ejection module 40 is also stopped. As the supply valve 52, for example, a solenoid valve, which is opened and closed by a force generated by a solenoid, can be used. However, any other configuration, such as a valve opened or closed by a driving force of a motor, or the like may be employed. The supply valve 52 corresponds to an openable mechanism. The position of the supply valve 52 is not limited on the supply tube 50. The supply valve 52 may be provided at the supply port 40A of the ink-droplet ejection module 40 to open and close the supply port 40A.

One end of a recovery common tube 54 is also connected to the ink tank 44. The recovery common tube 54 is also made in tubular form, and the ink can flow through the tube. The recovery common tube 54 corresponds to a common discharge flow path (recovery common flow path). One ends of plural recovery tubes 55 are respectively connected at plural different positions of the recovery common tube 54, and the other ends of the plural recovery tubes 55 are respectively connected to the discharge ports 40B of the plural ink-droplet ejection modules 40. Each of the recovery tubes 55 is also made in tubular form, and the ink can be flow though the tube. The recovery tube 55 corresponds to a discharge flow path. The above-described recovery tubes 55 and the recovery common tube 54 form a discharge flow path for guiding the ink discharged from the discharge ports 40B of the plural ink-droplet ejection modules 40 to the ink tank 44.

Figure 3A:
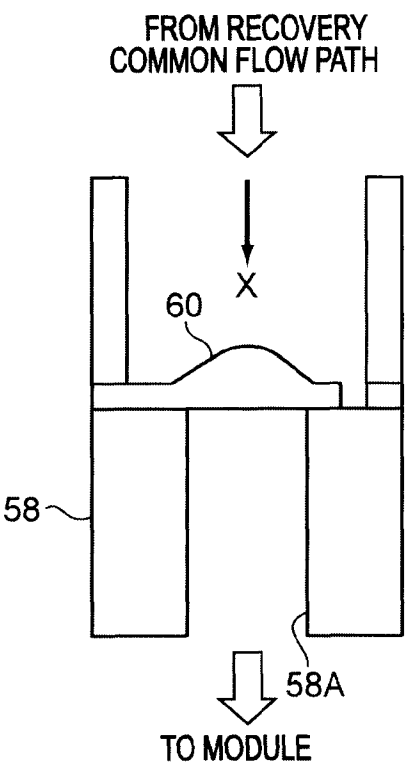
FIGS. 3A to 3C are schematic diagrams showing an example of a configuration of a one-way valve.
Figure 3B:
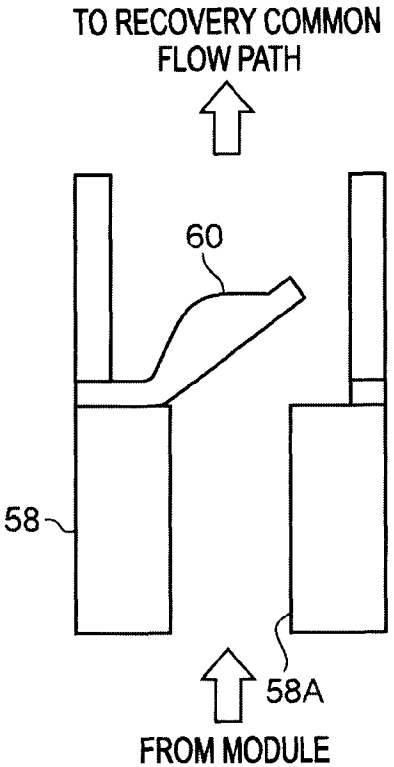
Figure 3C:
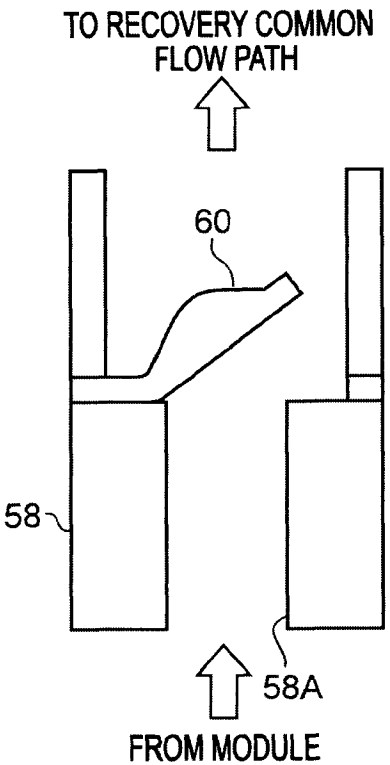

At each of the recovery tubes 55 is disposed a one-way valve 56 that permits flow of the ink in a direction from the ink-droplet ejection module 40 toward the recovery common tube 54, but blocks flow of the ink from the recovery common tube 54 toward the ink-droplet ejection module 40. The one-way valve 56 according to the exemplary embodiment includes a stop member 58 and a valve element 60 as shown in FIG. 3. The stop member 58 is formed in columnar shape, and is provided with a through-hole 58A along its axial line, through which the ink can flow. The valve element 60 is formed of a flexible material, has a substantially flat shape that can cover the entire opening of the through-hole 58A. One end portion (base portion) of the valve element 60 is fixed to one end surface of the stop member 58, and an intermediate portion thereof is folded so that the other end portion (tip portion) is located at an opening position separated by a predetermined distance from the end surface of the stop member 58 (refer to FIGS. 3B and 3C).

By this configuration, when the ink is not flowing inside the recovery tube 55, or when there is no pressure difference between the ink-droplet ejection module 40 side and the recovery common tube 54 side with respect to the one-way valve 56, the valve element 60 is located at the opening position at which the tip portion of the valve element 60 is separate from the end surface of the stop member 58, as shown in FIG. 3C. When the ink flows through the recovery tube 55 from the ink-droplet ejection module 40 toward the recovery common tube 54, the valve element 60 is still kept in the opening position as shown in FIG. 3B. On the other hand, when the ink flows through the recovery tube 55 from the recovery common tube 54 toward the ink-droplet ejection module 40, the valve element 60 is pressed toward the ink-droplet ejection module 40 side by the ink flowing into the one-way valve 56 from the recovery common tube 54 side, thereby the valve element 60 is displaced so that the tip portion of the valve element 60 moves to a closing position at which the tip portion contacts with the end surface of the stop member 58, as shown in FIG. 3A. Thus, the flow of the ink from the recovery common tube 54 toward the ink-droplet ejection module 40 in the recovery tube 55 is blocked.

At the recovery common tube 54, a recovery pump 62 is also disposed. The recovery pump 62 can also rotate normally and reversely. When the recovery pump 62 is normally rotated, pressure (positive pressure) is applied to the recovery common tube 54 and the respective recovery common tubes 55 and the one-way valves 56 provided in the respective recovery tubes 55 is set to the closed state (refer to FIG. 3A). Further, the recovery pump 62 may be rotated reversely only for a short time in a state in which the pressure is applied to the recovery common tube 46 and the respective recovery tubes 55. In this case, the pressure applied to the recovery common tube 54 and the respective recovery tubes 55 is released, and the one-way valves 56 provided in the respective recovery tubes 55 return to the opened state (refer to FIGS. 3B and 3C). The recovery pump 62 corresponds to a pressure applying unit.

As described above, in the ink supply system 42 according to the exemplary embodiment, a circulation pathway for circulating the ink is formed by the ink tank 44, the supply common tube 46, the respective supply tubes 50, the respective ink-droplet ejection modules 40 of the ink jet recording head 20Y, the respective recovery tubes 55, and the recovery common tube 54. A controller 70, which is described later, actuates the supply pump 48 and the recovery pump 62 during a period when a maintenance operation, which is described later, is not performed (e.g., an image recording period when an image recording on the recording medium P is performed, or a stand-by period when an image recording is not performed) and generate pressure to circulates the ink through the circulation pathway. Thus the ink is circulated through the circulation pathway, and the ink remaining inside the circulation pathway is maintained to be clean.

Further, an end portion of the supply common tube 46 opposite to the end portion connected to the ink tank 44 and an end portion of the recovery common tube 54 opposite to the end portion connected to the ink tank 44 are connected with a communication tube 64. The communication tube 64 is also made in tubular form, and the ink can flow through the tube. The communication tube 64 corresponds to a communication flow path. A communication valve 66 formed by an openable valve is disposed at the communication tube 64. When the communication valve 66 is in an opened state, the ink can flow through the communication tube 64, and when the communication valve 66 is switched to a closed state, the flow of the ink inside the communication tube 64 (i.e., between the supply common tube 46 and the recovery common tube 54) is blocked. The communication valve 66 may be a solenoid valve or any other configuration. The communication valve 66 corresponds to a communication-flow-path openable mechanism.

The ink supply system 42 includes the controller 70. The controller 70 includes a CPU 70A, a memory 70B, and a nonvolatile storage 70C formed of a Hard Disk Drive (HDD), a flash memory or the like. The storage 70C stores a maintenance program for performing the maintenance processing described later by the CPU 70A. The supply pump 48 is connected with the controller 70 through a pump driving circuit 72, and the recover pump 62 is connected with the controller 70 through a pump driving circuit 74, respectively, so that the operations of the supply pump 48 and the recovery pump 62 are controlled by the controller 70. The respective supply valves 52 are connected to the controller 70 through valve driving circuits 76 and the communication valve 66 is connected to the controller 70 through a valve driving circuit 78, so that the opening and closing of the respective supply valves 52 and the communication valve 66 are also controlled by the controller 70.

The ink supply system 42 includes maintenance units (not shown) used when performing the maintenance operations for the respective ink-droplet ejection modules 40. The maintenance unit has caps that cover nozzle surfaces of the ink-droplet ejection modules 40 of the ink-jet recording heads 20Y to 20K, a receiving member that receives the ink droplets ejected in a preliminary ejection (idle ejection), a cleaning member that cleans the nozzle surfaces, and a suction device for suctioning the ink inside the nozzles. The maintenance unit can move to opposite positions where are opposing to the corresponding ink-droplet ejection module 40. The maintenance units are also connected to the controller 70 (not illustrated), are moved to the opposite positions in accordance with instructions from the controller 70, and perform various maintenance operations.

Although the illustration is omitted, the controller 70 is also connected to ejection mechanisms incorporated in the ink-jet recording heads 20Y to 20K (in the respective ink-droplet ejection modules 40 thereof), and performs ink-droplet ejection control processing, in which the nozzle to eject the ink droplet, and an eject time of the ink droplet from the nozzle are determined in accordance with an image signal, and a drive signal is supplied to the corresponding ejection mechanism at a time in accordance with the determined ejection time. Further, processing for controlling the operation of the overall ink-jet recording apparatus 10 may be also performed in the controller 70.

Figure 4:
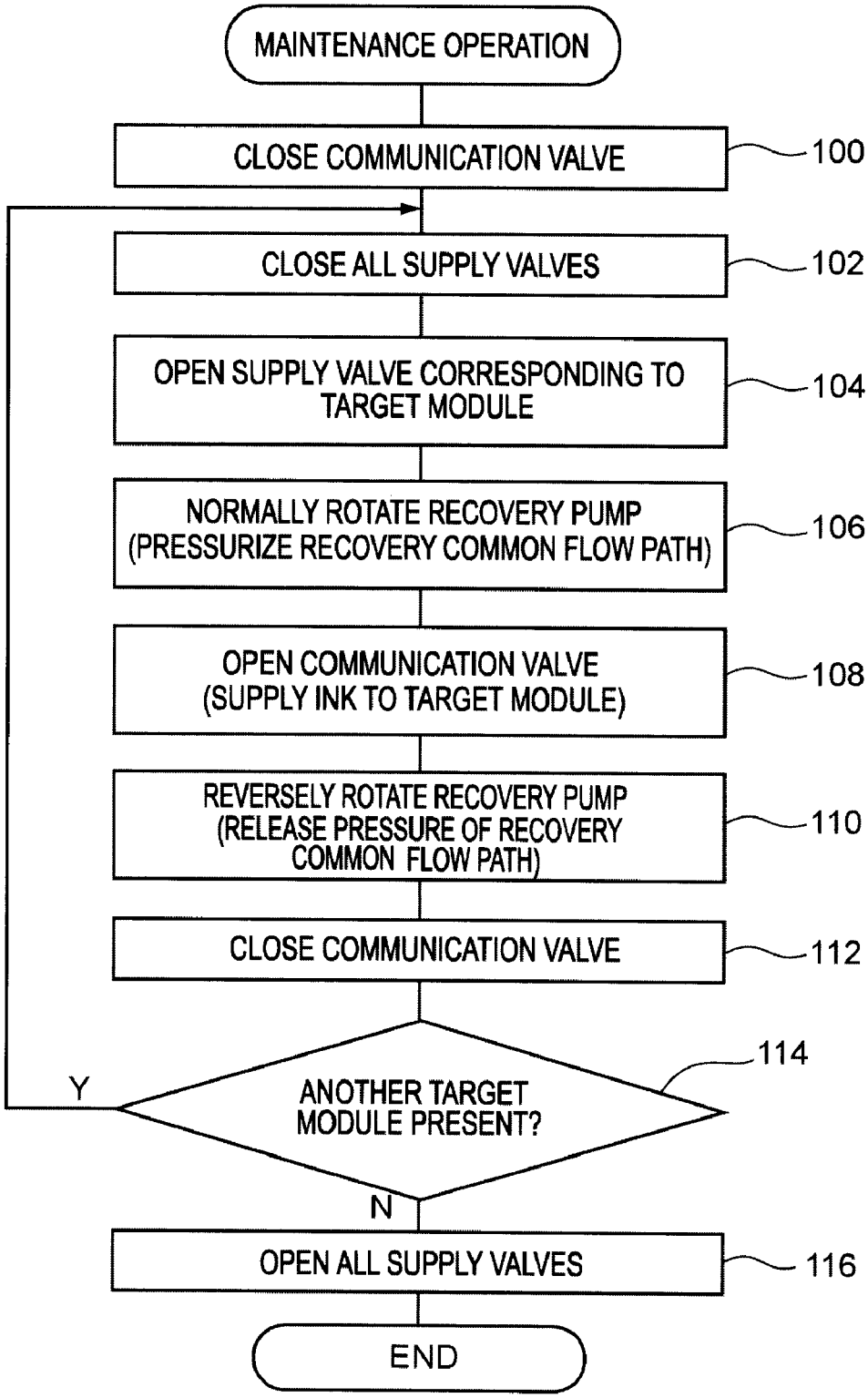
FIG. 4 is a flowchart of maintenance processing according to the first exemplary embodiment.

Next, the maintenance processing performed by the controller 70 as a result of the CPU 70A executing the maintenance program is described as an operation of the first exemplary embodiment with reference to FIG. 4, taking a case in which the maintenance operation is performed for any one of the ink-droplet ejection modules 40 of any recording head 20 of the ink-jet recording heads 20Y to 20K as an example.

In this maintenance processing, firstly, in step 100, the communication valve 66 is closed by the valve driving circuit 78. Thus the flow of the ink between the supply common tube 46 and the recovery common tube 54 is blocked. In next step 102, all of the supply valves 52 provided at the respective supply tubes 50 are closed by the valve driving circuits 76. In next step 104, only the supply valve 52 corresponding to the ink-droplet ejection module 40 of a maintenance target (target ink-droplet ejection module 40) is opened. Thereby, the ink can be supplied only to the target ink-droplet ejection module 40 among the ink-droplet ejection modules 40.

In step 106, the recovery pump 62 is normally rotated by the pump driving circuit 74. Due to the normal rotation of the recovery pump 62, pressure (positive pressure) is applied to the recovery common tube 54 (the common discharge flow path) and the respective recovery tubes 55 (the discharge flow paths). The one-way valve 56 provided in each of the recovery tubes 55 is closed (refer to FIG. 3A) as a result of the ink pressing the valve element 60. In this manner, by using the one-way valve 56 as the openable mechanism that opens and closes the discharge flow path, the recovery flow path may be closed only by normally rotating the existing recovery pump 62, which makes unnecessary to provide a configuration for actively opening and closing the openable mechanism.

In step 108, the communication valve 66 is opened by the valve driving circuit 78. Thereby, the pressure (positive pressure) applied to the recovery common tube 54 (and the respective recovery tubes 55) is transmitted to the supply common tube 46 (common supply flow path) via the communication tube 64 and the communication valve 66, and the common supply flow path is also applied positive pressure. However, since only the supply valve 52 corresponding to the target ink-droplet ejection module 40 is in the opened state at this time, the ink is supplied only to the target ink-droplet ejection module 40.

In step 108, since all of the one-way valves 56 including the one-way valve 56 corresponding to the target ink-droplet ejection module 40 are kept in the closed state by the pressure (positive pressure) applied to the recovery flow paths, the ink (ink that is relatively highly deteriorated) retained inside the target ink-droplet ejection module 40 is all ejected as ink droplets from the target nozzles of the ink-droplet ejection module 40. As a result, the ink inside the target ink-droplet ejection module 40 is replaced by relatively clean ink which is newly supplied to the target ink-droplet ejection module 40. Moreover, since the one-way valve 56 is closed, the ink ejected from the discharge port 40B of the target ink-droplet ejection module 40 is prevented from entering the other ink-droplet ejection modules 40.

In step 108, the controller 70 causes the maintenance unit to perform the maintenance processing for the target ink-droplet ejection module 40. Thereby, the ink droplets ejected from the nozzles of the target ink-droplet ejection module 40 is adhered to the receiving member of the maintenance unit and the ink droplets are prevented from scattering. Further, the nozzle surfaces of the target ink-droplet ejection module 40 are cleaned by the cleaning member of the maintenance unit, and the target ink-droplet ejection module 40 returns to a state which is capable to eject, in response to a supply of the drive signal to the ejection mechanism, the ink droplets precisely corresponding to the supplied drive signal.

In this way, when the maintenance operation for the target ink-droplet ejection module 40 has been completed, in next step 110, the recovery pump 62 is reversely rotated for a predetermined short time by the pump driving circuit 74, and in step 112, the communication valve 66 is closed by the valve driving circuit 78. Thereby, the pressure (positive pressure) applied to the recovery common tube 54 (the common discharge flow path), the respective recovery tubes 55 (the discharge flow paths), and the supply common tube 46 (common supply flow path) is released, and the one-way valves 56 provided in the respective recovery tubes 55 return to the opened state (refer to FIGS. 3B and 3C). Further, the supply of the ink to the target ink-droplet module 40 is stopped.

In next step 114, it is determined whether or not any other ink-droplet module 40 to which the maintenance operation should be performed is present. When the determination is affirmative, the processing returns to step 102, and steps 102 to 114 are repeated until the determination in step 114 is negative. Thereby, the processing in steps 102 to 114 is performed to the ink-droplet ejection modules 40 to which the maintenance operation should be performed, as the maintenance targets, respectively. When the maintenance operations for all of the target ink-droplet ejection modules 40 has been completed, the determination in step 114 is negative, and the processing moves to step 116, in which all the of supply valves 52 are opened by the valve driving circuits 76, and the maintenance processing ends.

Second Exemplary Embodiment

Figure 5:
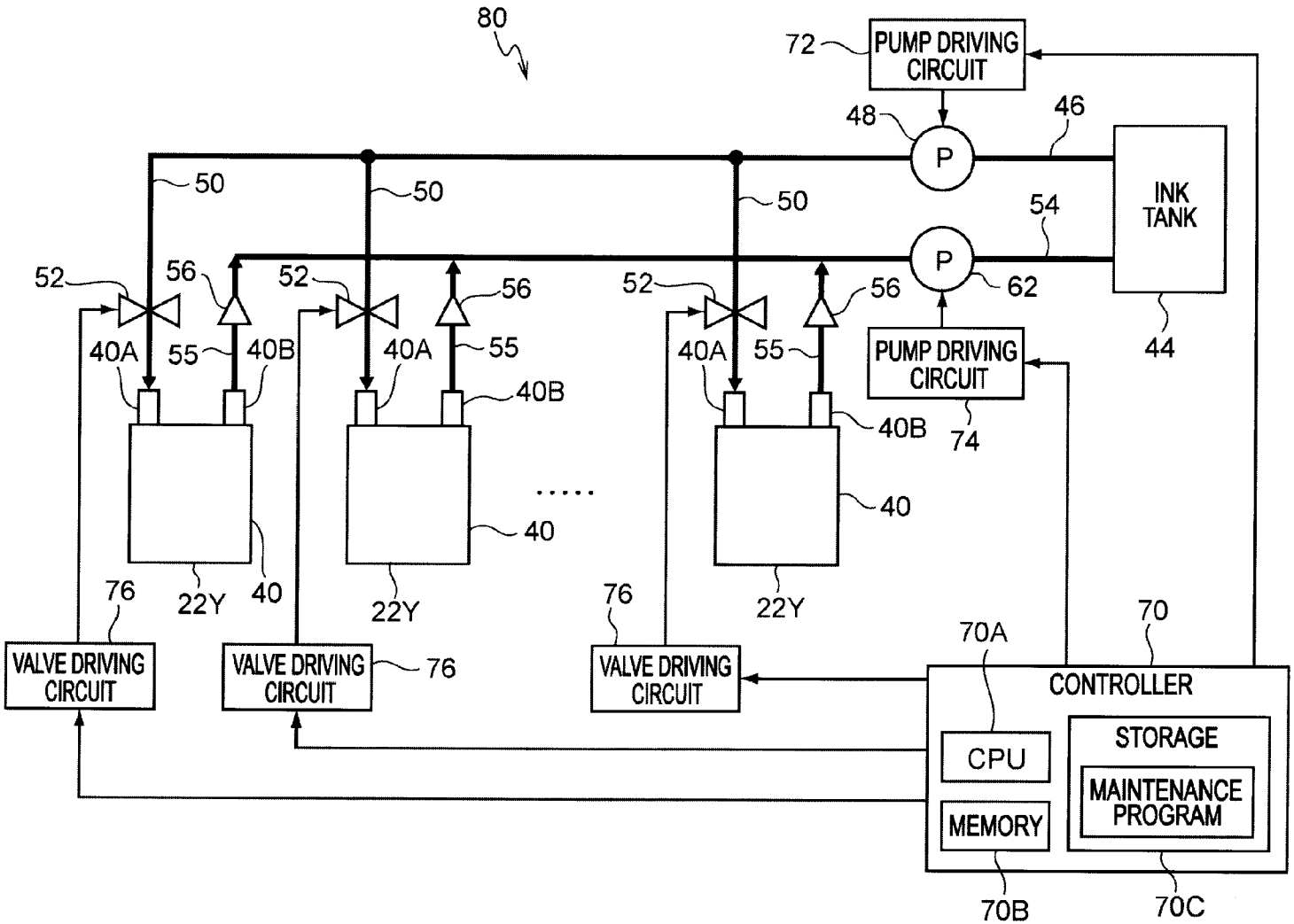
FIG. 5 is a schematic configuration diagram of an ink supply system according to a second exemplary embodiment.

Next, a second exemplary embodiment is described. The same parts as those in the first exemplary embodiment are given the same reference numerals, and only different parts from those in the first exemplary embodiment are described. FIG. 5 shows an ink supply system 80 according to the second exemplary embodiment. The ink supply system 80 is different from the ink supply system 42 described in the first exemplary embodiment in that the communication tube 64, the communication valve 66, and the valve driving circuit 78 are omitted. In the second exemplary embodiment, the supply pump 48 and the recovery pump 62 correspond to the pressure applying unit.

Figure 6:
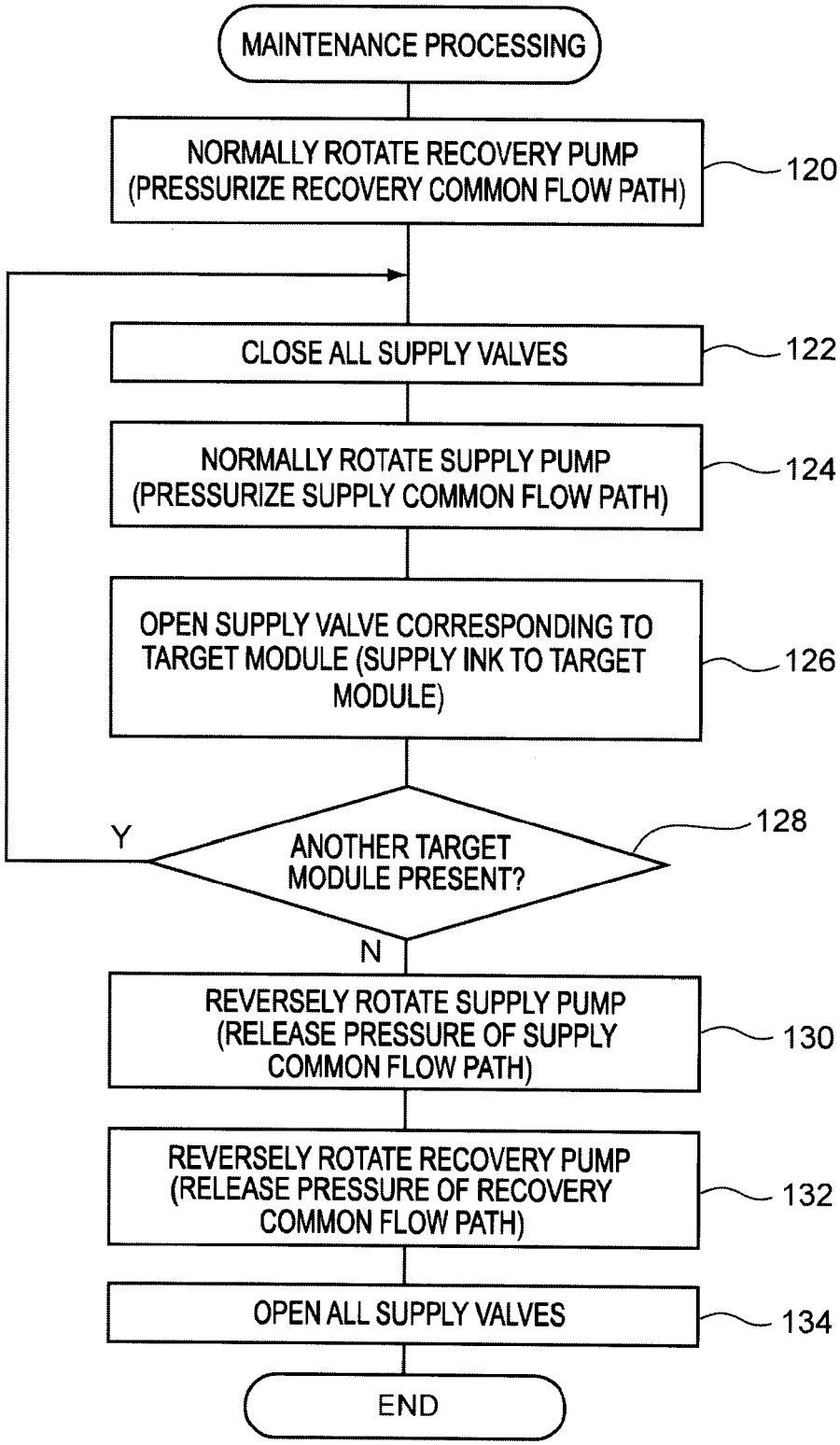
FIG. 6 is a flowchart of maintenance processing according to the second exemplary embodiment.

Next, as an operation of the second exemplary embodiment, a maintenance processing according to the second exemplary embodiment is described by referring to FIG. 6. In the maintenance processing, first, in step 120, the recovery pump 62 is normally rotated by the pump driving circuit 74. Due to the normal rotation of the recovery pump 62, pressure (positive pressure) is applied to the recovery common tube 54 (the common flow discharge path) and the respective recovery tubes 55 (the discharge flow paths). The one-way valves 56 provided in the respective recovery tubes 55 are closed (refer to FIG. 3A) by the ink pressing the valve element 60. In next step 122, all the supply valves 52 provided in the respective supply tubes 50 are closed through the valve driving circuits 76. In step 124, the supply pump 48 is also rotated normally by the pump driving circuit 72. Due to this normal rotation of the supply pump 48, pressure (positive pressure) is also applied to the supply common tube 46 (common supply flow path).

In next step 126, only the supply valve 52 corresponding to the ink-droplet ejection module 40 as a maintenance target (target ink-droplet ejection module 40) is opened by the valve driving circuit 76. At this time, since the supply valve 52 corresponding to the target ink-droplet ejection module 40 is only in the opened state, the ink is supplied only to the target ink-droplet ejection module 40 from the supply common tube 46.

In step 126, the ink droplets are ejected from all the nozzles of the target ink-droplet ejection module 40. At this time, since all the one-way valves 56 including the one-way valve 56 corresponding to the target ink-droplet ejection module 40 are kept in the closed state due to the pressure (positive pressure) applied to the recovery flow paths, the ink (ink which is relatively highly deteriorated) retained inside the target ink-droplet ejection module 40 is all ejected as the ink droplets from the nozzles of the target ink-droplet ejection module 40. As a result, the ink inside the target ink-droplet ejection module 40 is replaced by relatively clean ink which is newly supplied to the target ink-droplet ejection module 40.

In step 126, the controller 70 causes the maintenance unit to perform the maintenance operation for the target ink-droplet ejection module 40. Thereby, the ink droplets ejected from the nozzles of the target ink-droplet ejection module 40 adhere to the receiving member of the maintenance unit and the ink droplets are prevented from scattering. Further, the nozzle surfaces of the target ink-droplet ejection module 40 are cleaned by the cleaning member of the maintenance unit, and the target ink-droplet ejection module 40 returns to a state that is capable to eject, in response to a supply of the drive signal to the ejection mechanism, the ink droplets precisely corresponding to the supplied drive signal.

When the maintenance for the target ink-droplet ejection module 40 has been completed, in next step 128, it is determined that whether or not any other ink-droplet ejection module 40 to which the maintenance operation should be performed is present. When the determination is affirmative, the processing returns to step 122, and steps 122 to 128 are repeated until the determination in step 128 is negative. Thereby, the processing of steps 122 to 128 is performed to the respective ink-droplet ejection modules 40 to which the maintenance operations should be performed, as the maintenance targets.

When the maintenance for all of the target ink-droplet ejection modules 40 has been completed, the determination in step 128 is negative, and the processing moves to step 130, in which the supply pump 48 is reversely rotated for a predetermined short time by the pump driving circuit 72. Thereby, the pressure (positive pressure) applied to the supply common tube 46 (the common supply flow path), the respective supply tubes 50 (the supply flow paths) is released, and the supply of the ink to the target ink-droplet ejection module 40 is also stopped. In step 132, the recovery pump 62 is reversely rotated for a predetermined short time by the pump driving circuit 74. Thereby, the pressure (positive pressure) applied to the recovery common tube 54 (the common discharge flow path), and the respective recovery tubes 55 (the discharge flow paths) is also released, and the one-way valves 56 provided in the respective recovery tubes 55 return to the opened state (refer to FIGS. 3B and 3C). In step 134, all of the supply valves 52 are opened by the valve driving circuits 76, and the maintenance processing ends.

In the foregoing, although the one-way valve having the configuration as shown in FIG. 3 is described, the one-way valve is not limited to this and, for example, a configuration shown in FIG. 7 may be employed.

Figure 7B:
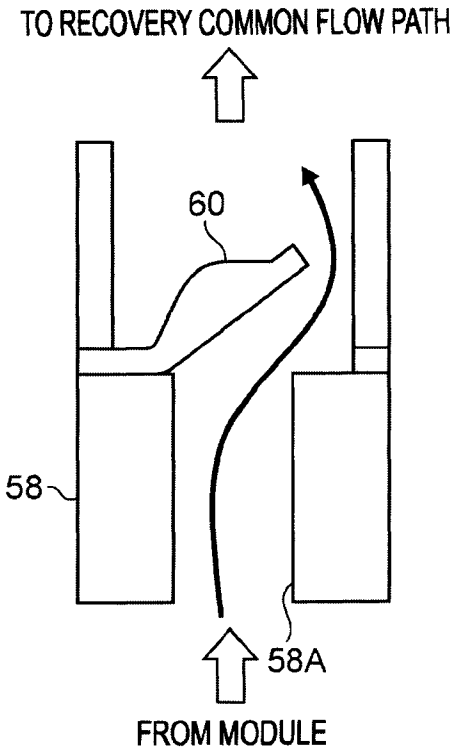
FIGS. 7A to 7B are schematic diagrams showing another example of the configuration of the one-way valve.
Figure 7A:
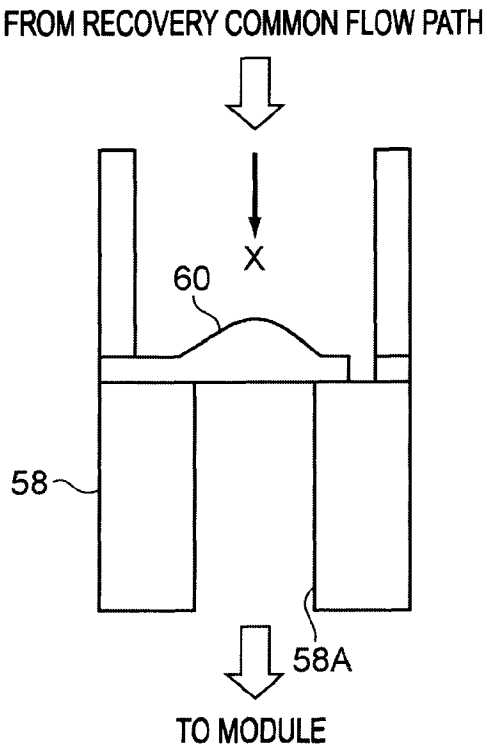

A one-way valve shown in FIG. 7 is different from the one-way valve shown in FIG. 3 in that the intermediate portion of the valve element 60 is not folded in static condition. In addition to when a pressure (positive pressure) is applied to the recovery common tube 54 (the common discharge flow path) and the respective recovery tubes 55 (the discharge flow paths), when the ink does not flow inside the recovery tubes 55 or when there is no pressure difference between the ink-droplet ejection module 40 side and the recovery common tube 54 side with respect to the one-way valve 56, the valve element 60 is kept in the closed state in which the tip portion of the valve elements 60 is in contact with the end surface of the stop member 58 as shown in FIG. 7A. On the other hand, when the ink flows inside the recovery tube 55 from the ink-droplet ejection module 40 toward the recovery common tube 54, the valve element 60 is pressed toward the recovery common tube 54 by the ink flowing into the one-way valve 56 from the ink-droplet ejection module 40, and the valve element 60 is displaced so that the tip portion thereof moves to the opening position from the end surface of the stop member 58 as shown in FIG. 7B. Thereby, the ink is distributed from the ink-droplet ejection module 40 side to the recovery common tube 54 side. When the configuration shown in FIG. 7 is applied for the one-way valve, the one-way valve (valve element 60) becomes a resistance to the distribution of the ink from the ink-droplet ejection module 40 side to the recovery common tube 54 side and, therefore, the configuration shown in FIG. 3 may be preferable.

Further, the one-way valve according may have a configuration shown in FIG. 8. The one-way valve shown in FIG. 8 has a spherical valve element 84 formed of a material having a larger specific gravity than that of the liquid such as the ink, and a housing part 86 that houses the valve element 84. The housing part 86 is formed in a columnar shape, is provided with a through-hole 86A along an axial line thereof, and is arranged so that the axial line extends in a vertical direction. A diameter of the through-hole 86A is smaller than that of the valve element 84. In the through-hole 86A, there is formed an inclined portion 86B having a diameter gradually increasing upward from an intermediate portion of the housing part 86 along the vertical direction and thus having a shape corresponding to a part of a cone. A housing portion 86C having a diameter larger than that of the valve element 84 is formed in an upper portion of the inclined portion 86B.

Figure 8B:
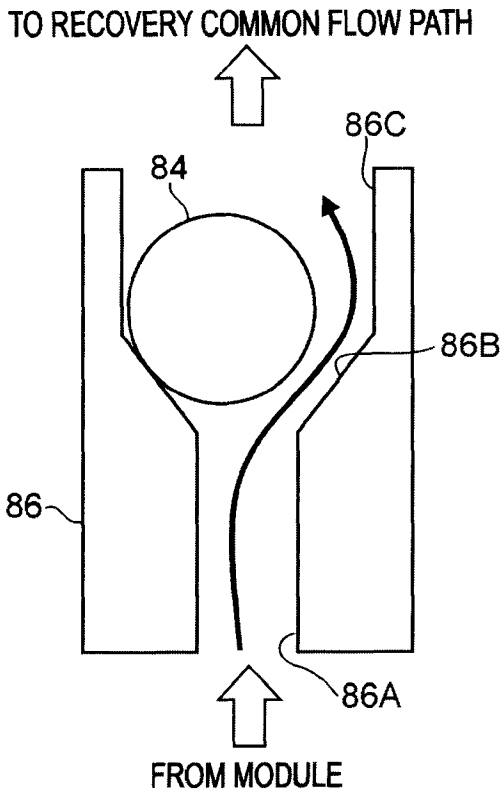
FIGS. 8A and 8B are schematic diagrams showing yet another example of the configuration of the one-way valve.
Figure 8A:
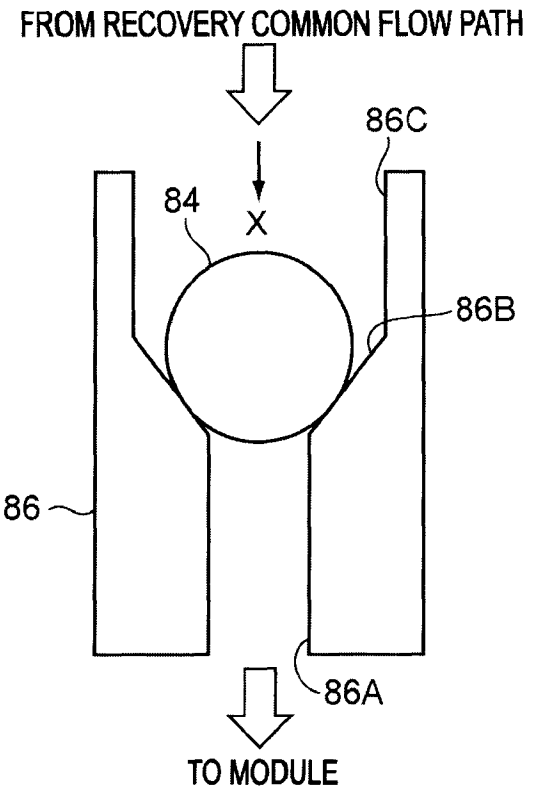

In the one-way valve shown in FIG. 8, when pressure (positive pressure) is applied to the recovery common tube 54 (the common discharge flow path) and the respective recovery tubes 55 (the discharge flow paths), when the ink does not flows through the recovery tube 55, or when there is no pressure difference between the ink-droplet ejection module 40 side and the recovery common tube 54 side with respect to the one-way valve 56, as shown in FIG. 8A, the valve element 84 comes into contact with the inclined portion 86B by gravity acting on the valve element 84, and is kept in a state in which it closes the flow path inside the one-way valve (through-hole 86A). On the other hand, when the ink flows through the recovery tube 55 from the ink-droplet ejection module 40 toward the recovery common tube 54, the valve element 84 is pressed toward the recovery common tube 54 by the ink flowing into the one-way valve from the ink-droplet ejection module 40, and the valve element 84 moves upward along the inclined surface of the inclined portion 86B as shown in FIG. 8B, which allows the ink to flow from the ink-droplet ejection module 40 toward the recovery common tube 54. When the configuration shown in FIG. 8 is applied for the one-way valve as well, the one-way valve (valve element 84) becomes a resistance to the flow of the ink from the ink-droplet ejection module 40 toward the recovery common tube 54 and, thus, the configuration shown in FIG. 3 is preferable.

In the foregoing description, the configuration in which, by applying a positive pressure to the recovery common tube 54 (the common discharge flow path), a high pressure is applied to the recovery common tube 54 side with respect to the one-way valve to put the one-way valves into the closed state has been described as the pressure applying unit. However, the pressure applying unit is not limited to the above-described configuration. A configuration may be also employed, in which, by applying a negative pressure to the ink-droplet ejection module 40 side with respect to the one-way valve, the high pressure is applied to the recovery common tube 54 side to put the one-way valve into the closed state.

Furthermore, in the foregoing description, although the ink jet recording apparatus is described as an example of the droplet ejection apparatus, the droplet ejection apparatus according is not limited to this. The droplet ejection apparatus may be, for example, a color filter manufacturing apparatus that ejects ink or the like on a film or glass to manufacture a color filter, an apparatus that ejects an organic EL solution on a substrate to form an EL display panel, an apparatus that ejects solder in a fused state on a substrate to form a bump for component mounting, an apparatus that ejects liquid including metal to form a wiring pattern, various types of film formation apparatuses that eject droplets to form a film, or any other apparatus that ejects droplets.

What is claimed is:

1. A droplet ejection apparatus comprising:

a plurality of droplet ejection units each respectively including a supply port for supplying liquid, a discharge port for discharging the liquid, and an ejection mechanism that ejects the supplied liquid as droplets;

a common supply flow path that supplies the liquid to the plurality of droplet ejection units;

a common discharge flow path that recovers the liquid from the plurality of droplet ejection units;

a plurality of supply flow paths that each connect the supply port of each of the plurality of droplet ejection units to the common supply flow path;

a plurality of openable mechanisms provided at the plurality of supply flow paths, respectively;

a plurality of discharge flow paths that each connect the discharge port of each of the plurality of droplet ejection units to the common discharge flow path;

a plurality of one-way valves that are respectively provided at the plurality of discharge flow paths to block the flow of the liquid from the common discharge flow path toward the discharge ports of the respective droplet ejection units;

a pressure applying unit that applies pressure so that a pressure in the plurality of discharge flow paths at the common discharge flow path side with respect to the respective one-way valves is higher than the plurality of discharge flow paths at the discharge port side; and a controller that when performing a maintenance operation of a selected droplet ejection unit, applies a pressure with the pressure applying unit so that the pressure in the plurality of discharge flow paths at the common discharge flow path side with respect to the respective one-way valves is higher than the plurality of discharge flow paths at the discharge port side, and opens only the openable mechanism corresponding to the selected droplet ejection unit from among the plurality of openable mechanisms.

2. The droplet ejection apparatus according to claim 1, further comprising:

a communication flow path that communicates the common supply flow path with the common discharge flow path; and a communication flow path openable mechanism provided at the communication flow path, wherein, when the communication flow path openable mechanism is closed, the controller applies a pressure with the pressure applying unit so that the pressure in the plurality of discharge flow paths at the common discharge flow path side with respect to the respective one-way valves is higher than the plurality of discharge flow paths at the discharge port side, opens only the openable mechanism corresponding to the selected droplet ejection unit from among the plurality of openable mechanisms, and then opens the communication flow path openable mechanism.

3. The droplet ejection apparatus according to claim 1, wherein:

the pressure applying unit applies positive pressure to the common discharge flow path, and further applies pressure to the common supply flow path independently of the common discharge flow path; and the controller applies the positive pressure to the common discharge flow path with the pressure applying unit, so that the pressure in the plurality of discharge flow paths in the common discharge flow path side with respect to the respective one-way valves is higher than the plurality of discharge flow paths at the discharge port side, applies the positive pressure to the common supply flow path with the pressure applying unit in a state in which the plurality of openable mechanisms are respectively closed, and then opens only the openable mechanism corresponding to the selected droplet ejection unit from among the plurality of openable mechanisms.

4. The droplet ejection apparatus according to claim 1, wherein:

the pressure applying unit applies positive pressure to the common discharge flow path, and further applies pressure to the inside of the common supply flow path independently of the common discharge flow path; and when the maintenance operation of the droplet ejection units is not performed, the controller opens the plurality of openable mechanisims respectively, and applies the positive pressure to the supply flow path by the pressure applying unit to circulate the liquid along a flow path comprising the common supply flow path, the respective supply flow paths, the respective droplet ejection units, the respective discharge flow paths, and the common discharge flow path.

* * * * *

UNITED STATES PATENT AND TRADEMARK OFFICE

CERTIFICATE OF CORRECTION

PATENT NO. : 8,308,263 B2
APPLICATION NO. : 12/642977
DATED : November 13, 2012
INVENTOR(S) : Atsushi Murakami et al.

It is certified that error appears in the above-identified patent and that said Letters Patent is hereby corrected as shown below:

ON THE TITLE PAGE:

Item (73) Assignee: "Fuji Xerox Co., Ltd., Tokyo (JP)" should read --Fuji Xerox Co., Ltd. and Fujifilm Corporation, both of Tokyo (JP)--

Signed and Sealed this
Eleventh Day of December, 2012

David J. Kappos

David J. Kappos
*Director of the United States Patent and Trademark Office*